US012389945B2

(12) United States Patent
Hoffmann

(10) Patent No.: US 12,389,945 B2
(45) Date of Patent: Aug. 19, 2025

(54) VAPOR CONDITIONING AND DISPENSING APPARATUS

(71) Applicant: AIRO Brands, Inc., Staten Island, NY (US)

(72) Inventor: Allen David Hoffmann, Westminster, CO (US)

(73) Assignee: AIRO BRANDS, INC., Staten Island, NY (US)

( * ) Notice: Subject to any disclaimer, the term of this patent is extended or adjusted under 35 U.S.C. 154(b) by 411 days.

(21) Appl. No.: 17/977,006

(22) Filed: Oct. 31, 2022

(65) Prior Publication Data

US 2024/0138476 A1 May 2, 2024

(51) Int. Cl.
*A24F 40/44* (2020.01)
*A24F 40/50* (2020.01)

(52) U.S. Cl.
CPC ..... *A24F 40/44* (2020.01); *A24F 40/50* (2020.01)

(58) Field of Classification Search
CPC ..... A24F 40/10; A24F 40/44; A24F 40/50
See application file for complete search history.

(56) References Cited

U.S. PATENT DOCUMENTS 10,306,927 B2 6/2019 Rostami et al.
11,154,669 B2 10/2021 Bowen et al.
11,357,934 B2 * 6/2022 Hawes ..... A61M 15/06
2015/0216237 A1 8/2015 Wensley et al.
2016/0374394 A1 * 12/2016 Hawes ..... A24F 40/485 131/329
2020/0113244 A1 * 4/2020 Novak, III ..... H01R 13/6205
2020/0359684 A1 * 11/2020 Bruton ..... A24F 40/30
2022/0313928 A1 * 10/2022 Hunt ..... A24F 40/42

OTHER PUBLICATIONS

International Search Report and Written Opinion issued in International Application No. PCT/US22/48356, dated Feb. 22, 2023, pp. 1-8.
International Report on Patentability issued in corresponding International Application No. PCT/US2022/048356, dated Apr. 29, 2025, pp. 1-6.

* cited by examiner

*Primary Examiner* — Abdullah A Riyami
*Assistant Examiner* — Thang H Nguyen
(74) *Attorney, Agent, or Firm* — Carter, DeLuca & Farrell LLP

(57) ABSTRACT

An apparatus for conditioning and dispensing vapor includes an atomizer, a body, and a mouth cap. The atomizer includes a first conduit. The body includes a leading end portion, a trailing end portion, and a second conduit. The second conduit has an internal diameter larger than an internal diameter of the first conduit. The trailing end portion of the body is in fluid communication with the atomizer. The mouth cap includes a leading end portion, a trailing end portion, and a third conduit. The trailing end portion of the mouth cap is in fluid communication with the leading end portion of the body. The leading end portion of the mouth cap has a cross-sectional area approximately equivalent to an internal diameter cross-sectional area of the first conduit.

20 Claims, 6 Drawing Sheets

VAPOR CONDITIONING AND DISPENSING APPARATUS

TECHNICAL FIELD

The present disclosure relates generally to the field of vaping apparatus, and more particularly, to vaping apparatus and methods for conditioning dispensed vapor.

BACKGROUND

Known vaping apparatus often have problems achieving desired vapor conditioning because such devices lack structure that sufficiently regulates vapor temperature and/or density. As a result, such vaping apparatus dispense overly dry and/or heated vapor that tends to cause discomfort in the throat, and in more severe cases, can engender lung inflammation and bronchitis.

SUMMARY

This disclosure is directed to vaping apparatus including vapor conditioning structure configured to lower vapor temperature and preserve vapor density of dispensed vapor for reducing throat discomfort and risks of lung inflammation and bronchitis.

An aspect of the present disclosure provides an apparatus for dispensing and conditioning vapor. The apparatus includes an atomizer, a body, and a mouth cap. The atomizer includes a first conduit. The body includes a leading end portion, a trailing end portion, and a second conduit. The second conduit of the body has an internal diameter larger than an internal diameter of the first conduit. The trailing end portion of the body is in fluid communication with the atomizer. The mouth cap includes a leading end portion, a trailing end portion, and a third conduit. The trailing end portion of the mouth cap is in fluid communication with the leading end portion of the body. The leading end portion of the mouth cap has a cross-sectional area approximately equivalent to an internal diameter cross-sectional area of the first conduit.

In an aspect of the present disclosure, the trailing end portion of the third conduit may have a cross-sectional area approximately equivalent to an internal diameter cross-sectional area of the second conduit. The cross-sectional area of the third conduit may taper down toward the leading end portion of the third conduit.

In aspect of the present disclosure, the apparatus may further include a power terminal configured to supply energy to the atomizer. The power terminal may be configured to mate with the trailing end portion of the body.

In an aspect of the present disclosure, the body may further include an outlet port configured to permit release of fluid from the body.

In an aspect of the present disclosure, the body may further include an inlet port configured to permit entrance of fluid into the body.

In an aspect of the present disclosure, the apparatus may further include wicking material proximate to the atomizer. The wicking material may be configured to supply fluid to the atomizer.

In an aspect of the present disclosure, the apparatus may further include an insert configured to control fluid movement. The insert may be disposed within the second conduit.

An aspect of the present disclosure provides an apparatus for dispensing and conditioning vapor. The apparatus includes an atomizer, a body, a mouth cap, and a container.

The atomizer includes a first conduit. The body includes a second conduit. The mouth cap includes a leading end portion, a trailing end portion, and a third conduit. The leading end portion of the third conduit has a cross-sectional area approximately equivalent to an internal diameter cross-sectional area of the first conduit. The container is disposed within the second conduit. The container includes a leading end portion, a trailing end portion, and a fourth conduit. The fourth conduit has an internal diameter larger than the internal diameter of the first conduit. The leading end portion of the container is in fluid communication with the trailing end portion of the mouth cap. The trailing end portion of the container is in fluid communication with the atomizer.

In an aspect of the present disclosure, a trailing end of the third conduit may have a cross-sectional area approximately equivalent to an internal diameter cross-sectional area of the fourth conduit. The cross-sectional area of the third conduit may taper down toward the leading end portion of the third conduit.

In an aspect of the present disclosure, the apparatus may further include a power terminal configured to supply energy to the atomizer.

In an aspect of the present disclosure, the body may further include an outlet port configured to enable release of fluid from the body.

In an aspect of the present disclosure, the body may further include an inlet port configured to enable ingress of fluid into the body.

In an aspect of the present disclosure, the apparatus may further include wicking material proximate to the atomizer. The wicking material may be configured to supply fluid to the atomizer.

In an aspect of the present disclosure, the apparatus may further include an insert configured to control fluid flow. The insert may be disposed within the fourth conduit.

An aspect of the present disclosure provides a method for dispensing and conditioning vapor. The method includes atomizing a fluid by an atomizer. The atomizer has a first conduit in fluid communication with a second conduit of a body. The second conduit is larger than the first conduit. The method next includes expanding the fluid as the fluid enters the second conduit. The second conduit is in fluid communication with a third conduit of a mouth cap. Finally, the method includes compressing the fluid as the fluid enters the third conduit.

In an aspect of the present disclosure, the method may include reducing a temperature of the fluid from a first temperature to a second temperature as the fluid enters the third conduit.

In an aspect of the present disclosure, the atomizing may be performed by causing the fluid to enter the atomizer through a wicking material disposed around an outer surface of the atomizer.

In an aspect of the present disclosure, the method may include supplying energy to the atomizer through a power terminal.

In an aspect of the present disclosure, the method may include causing the fluid to enter or to exit the body through a port.

In an aspect of the present disclosure, the method may include controlling a movement of the fluid through the second conduit by an insert disposed within the second conduit.

Further details and aspects of the present disclosure are described in more detail below with reference to the appended drawings.

BRIEF DESCRIPTION OF THE DRAWINGS

A better understanding of the features and advantages of the present disclosure will be obtained by reference to the following detailed description that sets forth illustrative aspects, in which the principles of the present disclosure are utilized, and the accompanying drawings of which.

DETAILED DESCRIPTION

Figure 1:
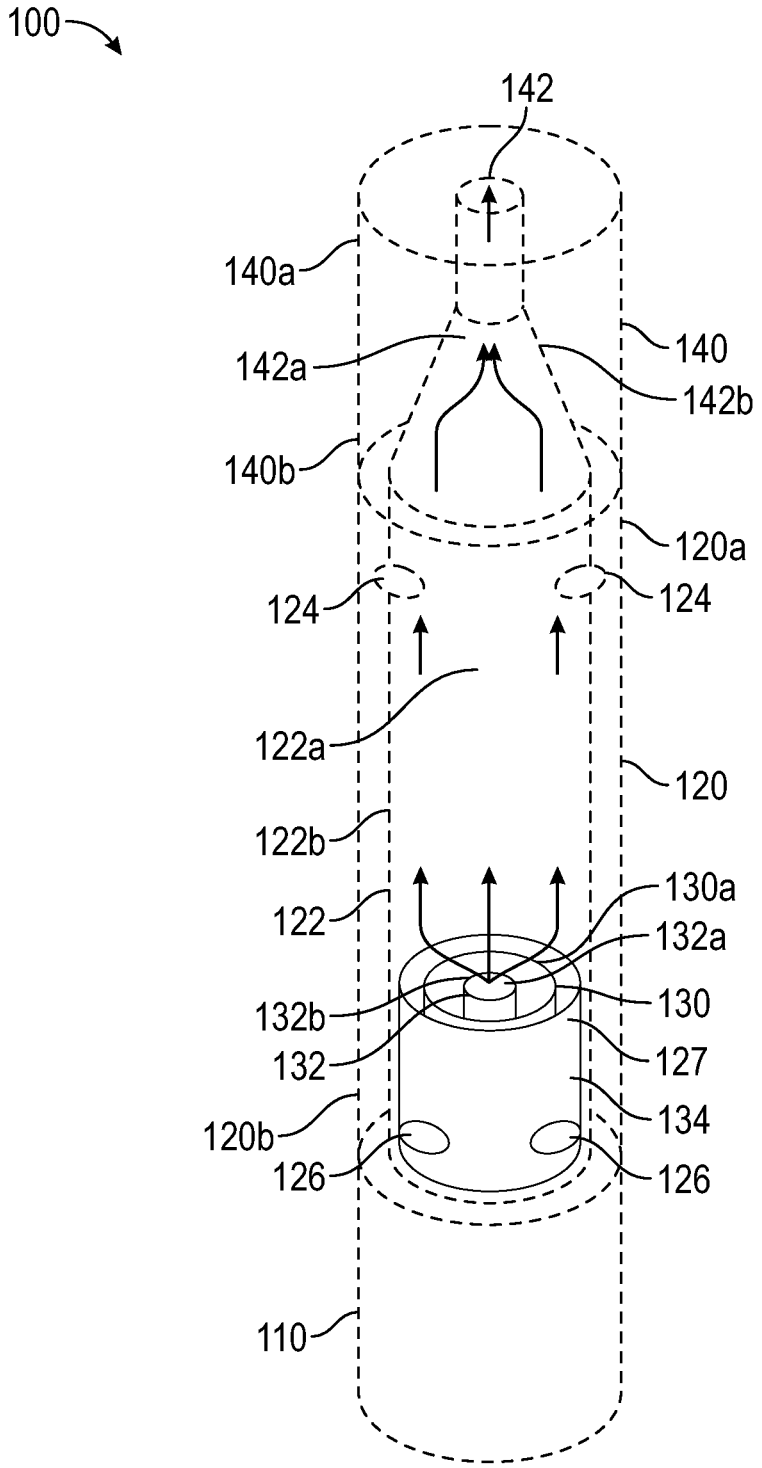
FIG. 1 is a perspective view of an apparatus for conditioning and dispensing vapor, in accordance with aspects of the disclosure.

The present disclosure relates generally to the field of vaping apparatus. More specifically, an aspect of the present disclosure provides systems and methods for conditioning and dispensing vapor.

Aspects of the present disclosure are described in detail with reference to the drawings wherein like reference numerals identify similar or identical elements.

Although the present disclosure will be described in terms of specific aspects and examples, it will be readily apparent to those skilled in this art that various modifications, rearrangements, and substitutions may be made without departing from the spirit of the present disclosure.

For purposes of promoting an understanding of the principles of the present disclosure, reference will now be made to exemplary aspects illustrated in the drawings, and specific language will be used to describe the same. It will nevertheless be understood that no limitation of the scope of the present disclosure is thereby intended. Any alterations and further modifications of the novel features illustrated herein, and any additional applications of the principles of the present disclosure as illustrated herein, which would occur to one skilled in the relevant art and having possession of this disclosure, are to be considered within the scope of the present disclosure. For illustrative purposes, the following detailed description is directed to vaping devices, however, other devices which require the conditioning and/or dispensing of vapor are within the scope of the present disclosure as well.

Referring to FIG. 1, an apparatus 100 for conditioning and dispensing vapor is shown. The apparatus 100 is configured to regulate the temperature and density of a vapor by causing the vapor to expand and compress before being dispensed. The apparatus 100 generally includes an atomizer 130, a body 120, and a mouth cap 140. The apparatus 100 may further include a power terminal 110 (e.g., a battery). The body 120 includes a leading end portion 120*a* configured to mate with the mouth cap 140 and a trailing end portion 120*b* configured to mate with the power terminal 110. The apparatus 100 provides an airpath that carries vapor from the atomizer 130 to the mouth cap 140 (e.g., a mouthpiece) in response to a negative pressure generated in the apparatus (e.g., a user inhalation).

The atomizer 130 is configured to convert a fluid (e.g., an oil precursor) into vapor, typically by using heat. For example, the atomizer 130 may have embedded or exposed heating elements configured for heating the fluid and converting the fluid to a vapor. The fluid may be stored in a container 127 that is in fluid communication with the atomizer 130. The atomizer 130 may generally be disposed within the body 120, particularly within a second conduit 122 of the body 120, but may be disposed elsewhere as needed. For example, the atomizer 130 may be disposed outside of and abutted to the body 120. The atomizer 130 may be made from ceramic or another suitable material. The atomizer 130 includes a leading end portion 130*a* and a first conduit 132. The first conduit 132 includes an internal surface 132*b* that defines a passage 132*a* therethrough. Energy may be supplied to the atomizer 130 by the power terminal 110 (e.g., connected to a battery). The power terminal 110 may be configured to mate with the body 120 via any suitable method, such as threading, magnetics, snap-fit, fastening, and/or any other suitable technique for joining components. The fluid may enter the atomizer 130, for example, through wicking material 134 from container 127. The wicking material 134 may be constructed from cotton, silica, mesh, hemp, rayon, and/or another suitable material. In aspects, the wicking material 134 may cover all sides of the atomizer 130, with the exception of the first conduit 132, but may generally surround the side walls of the atomizer 130. The atomizer 130 transforms the fluid into vapor by heating the fluid, which then enters the first conduit 132 as a vapor.

The body 120 includes the leading end portion 120*a*, the trailing end portion 120*b*, and a second conduit 122. The body 120 may generally be cylindrical but may include another suitable shape. The second conduit 122 includes an internal surface 122*b* that defines a passage 122*a* therethrough. The second conduit 122 has an internal diameter larger than an internal diameter of the first conduit 132. The second conduit 122 is in fluid communication with the first conduit 132. The body 120 may be constructed from glass, steel, alloy, ceramic, polycarbonate, polyamide, engineered thermoplastics, and/or any other suitable material. The mouth cap 140 is configured to mate with the body 120. The mouth cap 140 may be configured to mate with the body 120 via threading, magnetics, snap-fit, fastening, and/or any other suitable technique for joining components. In aspects, the mouth cap 140 may be integral with the body 120. The mouth cap 140 includes a leading end portion 140*a*, a trailing end portion 140*b*, and a third conduit 142. The third conduit 142 includes an internal surface 142*b* that defines a passage 142*a* therethrough. The third conduit 142 is in fluid communication with the second conduit 122. An internal diameter of the third conduit 142 is configured to transition from the internal diameter of the second conduit 122 to a cross-sectional area approximately equal to a cross-sectional inner diameter area of the first conduit 132. The mouth cap 140 may be made from glass, steel, alloy, ceramic, polycarbonate, polyamide, engineered thermoplastics, stone, and/or any other suitable material.

In aspects, the body 120 may include inlet port(s) 126 (e.g., oil inlet port) to introduce fluid into the atomizer 130 and/or wicking material 134 from container 127. The inlet port 126 is disposed proximate to the atomizer 130. In other aspects, the body 120 may include an outlet port 124 (e.g., air outlet port). The outlet port 124 is configured to permit vapor and/or air to be externally released from the apparatus 100 when the mouth cap 140 is attached to the body 120.

Figure 2A:
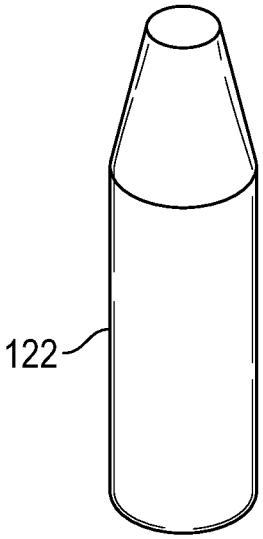
FIG. 2A is a perspective view of a conduit of a body and a conduit of a mouth cap of the apparatus of FIG. 1, in accordance with aspects of the disclosure.
Figure 2B:
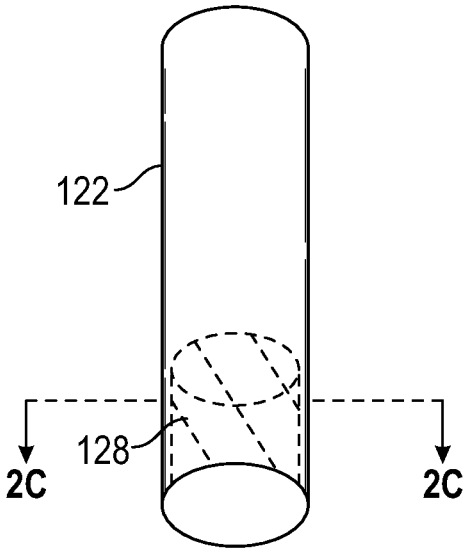
FIG. 2B provides a perspective view of an alternate conduit of the body of the apparatus of FIG. 1.
Figure 2C:
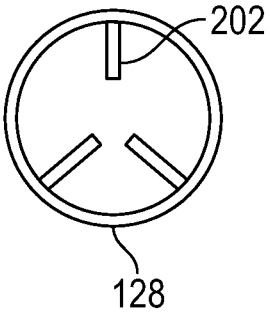
FIG. 2C provides a top view of an insert disposed within the body of the apparatus of FIG. 1, in accordance with aspects of the disclosure.

FIGS. 2A-2C illustrate example layouts of the second conduit 122. FIG. 2A illustrates that the second conduit 122 may be configured in such a way as to induce the Venturi effect, a reduction in fluid pressure caused by vapor flowing through a constricted area. In this configuration, the second conduit 122 may narrow at the leading end portion 120*a* of the body 120 such that the internal diameter of the second conduit 122 is equivalent to the internal diameter of the first conduit 132. The narrowing of the internal diameter of the second conduit 122 may occur linearly, exponentially, or in another suitable manner. FIG. 2B shows that vapor flow may be controlled in the second conduit 122 through use of an insert 128 disposed within the second conduit 122. As shown in FIGS. 2B and 2C, the insert 128 may include one or more beveled or angled fins 202 configured to spin the vapor through the second conduit 122. Although three fins 202 are shown, any suitable number of fins may be used. The fins 202 may be of any suitable shape and/or angle. The insert 128 may be a thermally conductive material and/or may be constructed from another suitable material. In aspects, the geometry of the insert 128 may be formed into the body 120 and/or second conduit 122.

Figure 3A:
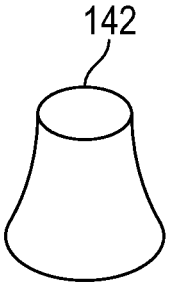
FIG. 3A is a perspective view of the conduit of a mouth cap of the apparatus of FIG. 1, in accordance with aspects of the disclosure.
Figure 3B:
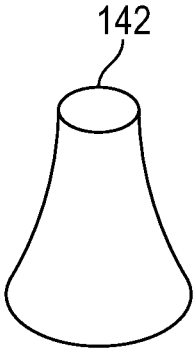
FIG. 3B is a perspective view of an alternate conduit of the mouth cap of the apparatus of FIG. 1, in accordance with aspects of the disclosure.
Figure 3C:
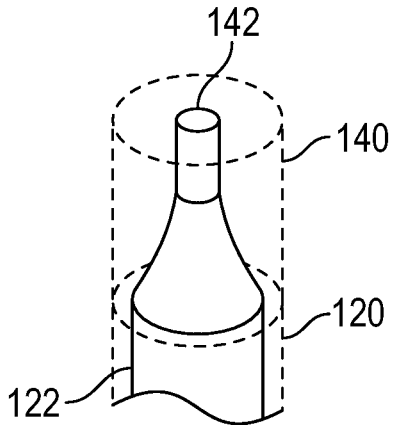
FIG. 3C is a perspective view of a leading portion of the apparatus of FIG. 1, in accordance with aspects of the disclosure.

FIGS. 3A through 3C display example configurations for the third conduit 142. The internal diameter of the third conduit 142 may decrease linearly, exponentially, or may have any other suitable curve. FIG. 3A shows a short third conduit 142 having a dramatic curve between the internal diameter of the third conduit 142 matching the internal diameter of the second conduit 122 and the internal diameter of the third conduit 142 matching the internal diameter of the first conduit 132. FIG. 3B shows an elongated third conduit 142 having a gentle, less dramatic curve between the internal diameter of the third conduit 142 matching the internal diameter of the second conduit 122 and the internal diameter of the third conduit 142 matching the internal diameter of the first conduit 132. As shown in FIG. 3C, the third conduit 142 may maintain a consistent internal diameter, with the reduction in the internal diameter cross-sectional area to that of the internal diameter cross-sectional area of the first conduit 132 instead occurring within the second conduit 122 (FIG. 2A).

Figure 4A:
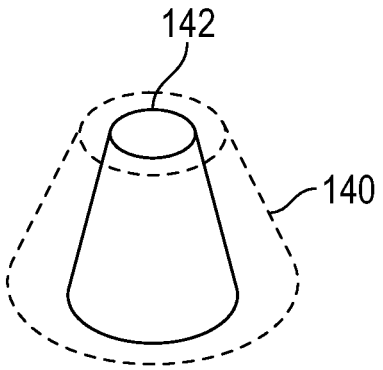
FIG. 4A is a perspective view of an alternate mouth cap of the apparatus of FIG. 1, in accordance with aspects of the disclosure.
Figure 4B:
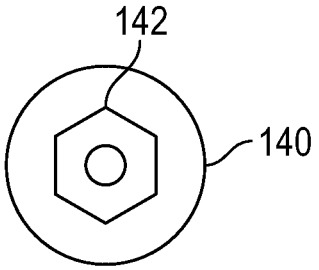
FIG. 4B is a top view of an alternate mouth cap of the apparatus of FIG. 1, in accordance with aspects of the disclosure.
Figure 4C:
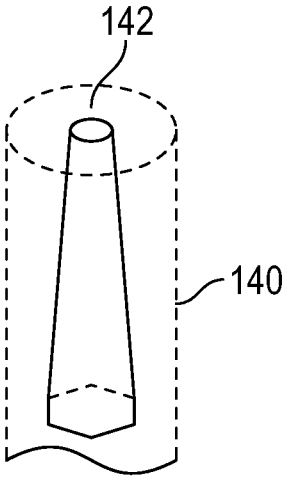
FIG. 4C is a perspective view of an alternate mouth cap of the apparatus of FIG. 4B, in accordance with aspects of the disclosure.

FIGS. 4A-4C depict the third conduit 142 in relation to the external appearance of the mouth cap 140. The third conduit 142 and the mouth cap 140 may both take a circular form and decrease linearly in diameter toward the leading end portion 140*a* (FIG. 4A). In aspects, the mouth cap 140 may instead maintain a consistent external diameter (FIG. 4C). A cross-sectional area of the third conduit 142 may differ in shape from the leading end portion 140*a* of the mouth cap 140 to the trailing end portion 140*b* of the mouth cap 140 (FIG. 4B).

Figure 5:
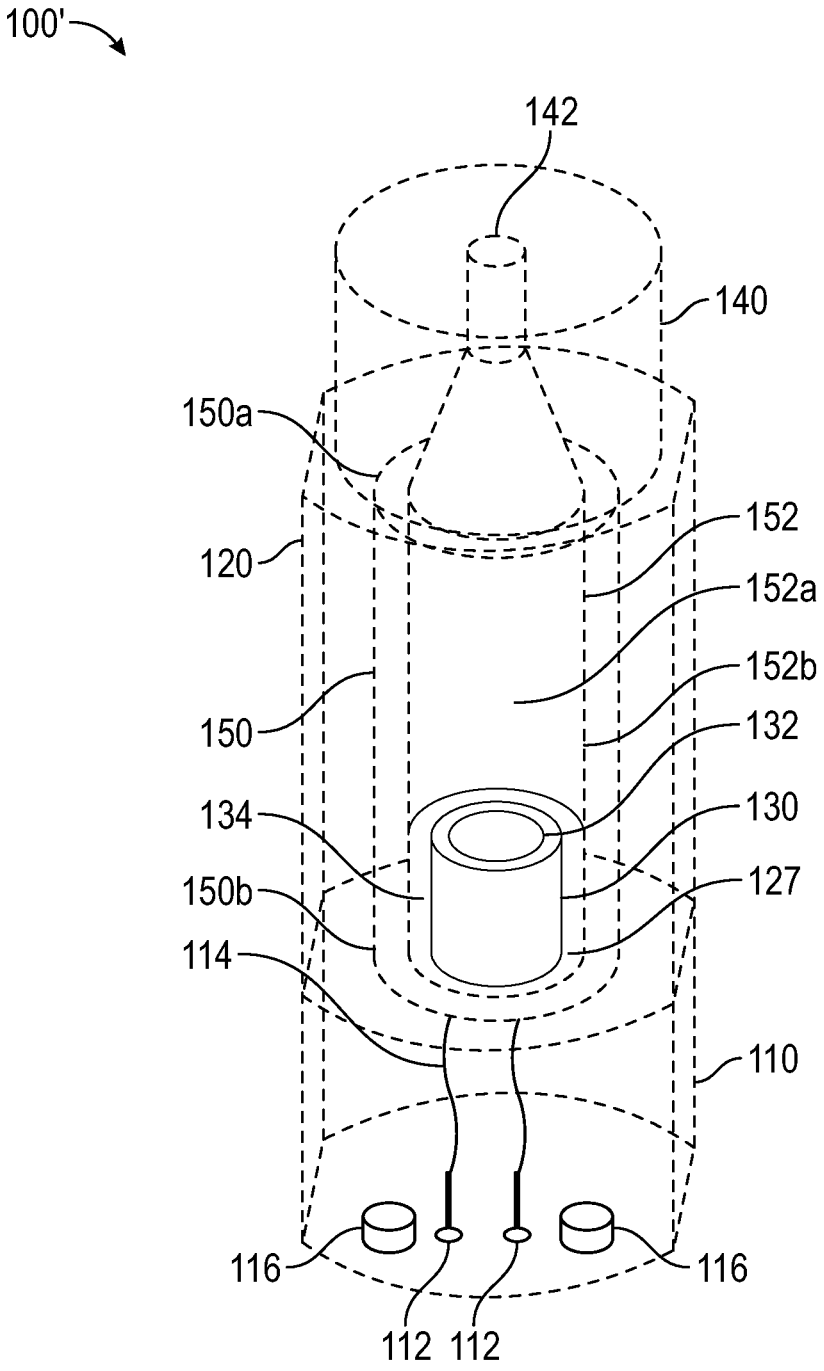
FIG. 5 is a perspective view of an alternate apparatus for conditioning and dispensing vapor, in accordance with aspects of the disclosure.

FIG. 5 displays an alternate configuration of the apparatus 100' including a container 150 within the body 120. The container 150 includes a leading end portion 150*a*, a trailing end portion 150*b*, and a fourth conduit 152 having an internal diameter larger than the internal diameter of the first conduit 132. The fourth conduit 152 includes an internal surface 152*b* that defines a passage 152*a* therethrough. As in FIG. 5, the atomizer 130 may be disposed in the fourth conduit 152. The fourth conduit 152 may be in fluid communication with the first conduit 132 and the third conduit 142. In aspects, the internal diameter of the third conduit 142 may be configured to transition from the internal diameter of the fourth conduit 152 to a cross-sectional area equal to a cross-sectional inner diameter area of the first conduit 132. The exterior shape of the body 120 and the power terminal 110 may be non-cylindrical. The power terminal 110 may include a wire 114 to connect the power terminal 110 to the atomizer 130. The wire 114 may be connected to a power-conducting pin 112. In aspects, the power terminal 110 may contain a magnet 116, where the magnet 116 is configured to allow the power terminal 110 to connect the apparatus 100' to a compatible dispensing device battery terminal.

Figure 6:
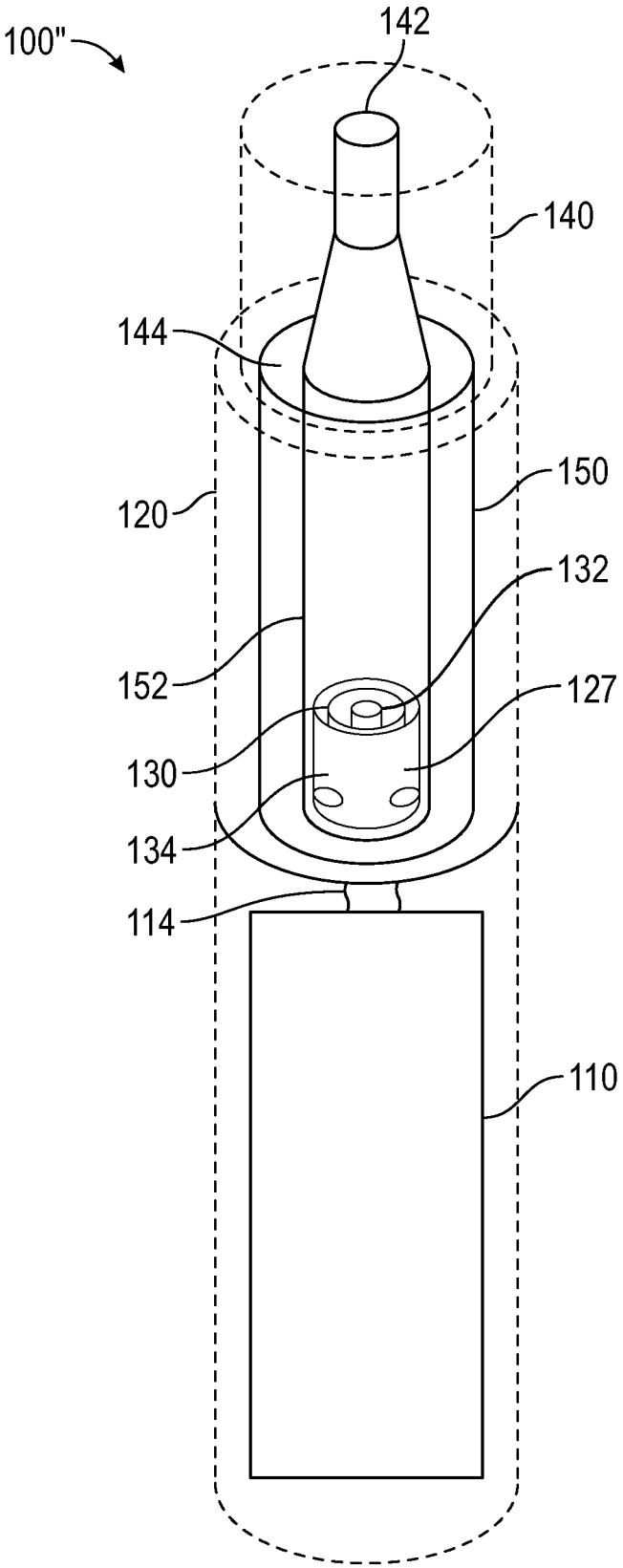
FIG. 6 is a perspective view of an alternate apparatus for conditioning and dispensing vapor, including the container of FIG. 5 and a power terminal disposed within the body, in accordance with aspects of the disclosure.

FIG. 6 shows a potentially disposable, all-in-one configuration of the apparatus 100". Referring to FIG. 6, all components, including the power terminal 110, are within a single body 120. To maintain a seal within the apparatus 100", in aspects, a gasket 144 may be disposed between the body 120 and the mouth cap 140.

Figure 7:
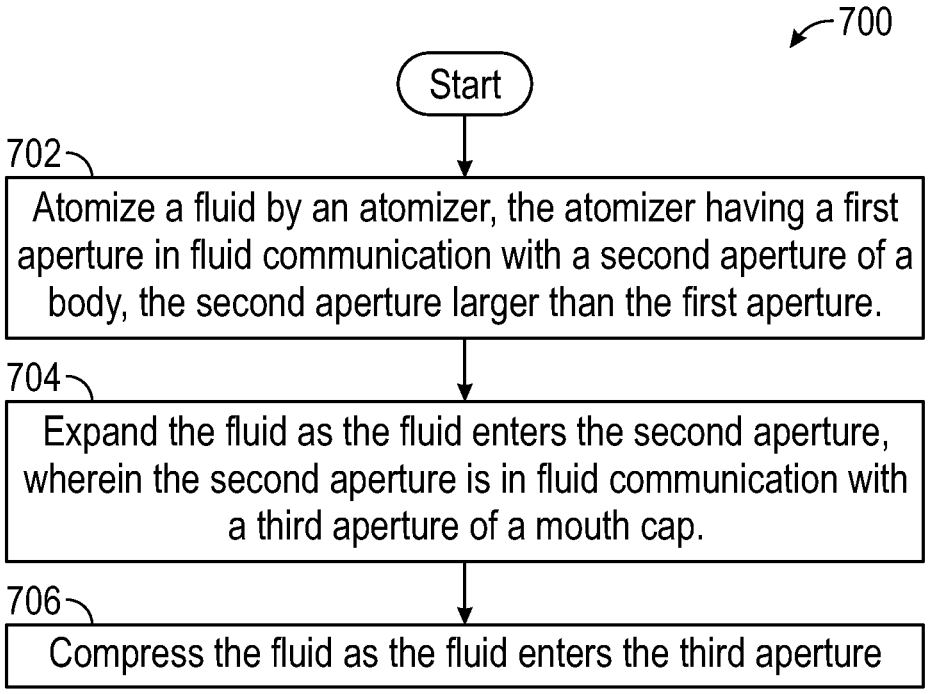
FIG. 7 is a flow diagram of a method for conditioning and dispensing vapor, in accordance with aspects of the present disclosure.

Referring to FIG. 7, a flow diagram for a method 700 of dispensing and conditioning vapor in accordance with the present disclosure is shown. Although the steps of FIG. 7 are shown in a particular order, the steps need not all be performed in the specified order, and certain steps can be performed in another order. These variations are contemplated to be within the scope of the present disclosure.

Initially, at step 702, the apparatus 100, 100', 100" receives and atomizes a fluid into a vapor through the atomizer 130 (FIGS. 1, 5, 6). For example, a user may atomize the fluid by powering on the power terminal 110 and/or by drawing a breath on the mouth cap 140. The atomizer 130 may be supplied energy to atomize the fluid into vapor by the power terminal 110 (e.g., by a battery). The fluid, which is stored in container 127, may enter the atomizer through an inlet port 126 in the body 120. The fluid may be dispersed into the atomizer 130 through wicking material 134 disposed on an outer surface of the atomizer 130, in container 127. The first conduit 132 of the atomizer 130 is in fluid communication with the second conduit 122 of the body 120. The second conduit 122 has an internal diameter larger than the internal diameter of the first conduit 132.

At step 704, the vapor flows from the first conduit 132 to the second conduit 122 (FIG. 1). As the second conduit 122 is larger than the first conduit 132, the vapor expands and experiences a decrease in temperature. The decrease in vapor density caused by the expansion in volume between the first conduit 132 and the second conduit 122 decreases the temperature of the vapor. In aspects, the vapor may flow through an insert 128 disposed within the second conduit 122. The insert 128 may cause a further dissipation of temperature of the vapor as the vapor moves through the second conduit 122. The second conduit is in fluid communication with the third conduit 142 of the mouth cap 140. The third conduit 142 ultimately has a cross-sectional internal diameter area equivalent to the cross-sectional internal diameter of the first conduit 132.

Finally, at step 706, the vapor within the second conduit 122 is compressed as the vapor flows into the third conduit 142. The expansion and compression of the vapor cools the temperature of the vapor relative to the initial temperature of the vapor when it is atomized. As the vapor flows through the third conduit 142 and exits the mouth cap 140, the user is supplied with vapor that is dense and temperature regulated. The disclosed technology provides the benefit of conditioning vapor density and providing a lower temperature vapor than an open airflow or a restricted airflow system would provide. Thus, the final temperature and density of the vapor are consistent and/or within the same ranges of the initial temperature and density of the vapor.

Certain aspects of the present disclosure may include some, all, or none of the above advantages and/or one or more other advantages readily apparent to those skilled in the art from the drawings, descriptions, and claims included herein. Moreover, while specific advantages have been enumerated above, the various aspects of the present disclosure may include all, some, or none of the enumerated advantages and/or other advantages not specifically enumerated above.

The aspects disclosed herein are examples of the disclosure and may be embodied in various forms. For instance, although certain aspects herein are described as separate aspects, each of the aspects herein may be combined with one or more of the other aspects herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an aspect," "in aspects," "in various aspects," "in some aspects," or "in other aspects" may each refer to one or more of the same or different example Aspects provided in the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The aspects described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. An apparatus for dispensing and conditioning vapor, the apparatus comprising:

an atomizer including a first conduit having an internal diameter, the atomizer configured to atomize a fluid into a vapor;

a body including a leading end portion, a trailing end portion, and a second conduit, the second conduit having an internal diameter larger than an internal diameter of the first conduit, wherein the trailing end portion of the body is in fluid communication with the atomizer, and wherein the second conduit is configured to receive the vapor from the first conduit and cause expansion of the vapor to reduce a temperature of the vapor; and a mouth cap including a leading end portion, a trailing end portion, and a third conduit, wherein the trailing end portion of the mouth cap is in fluid communication with the leading end portion of the body, wherein the leading end portion of the mouth cap has a cross-sectional area approximately equivalent to an internal diameter cross-sectional area of the first conduit, wherein the third conduit is configured to compress the expanded vapor to maintain vapor density and regulate a temperature of the vapor.

2. The apparatus of claim 1, wherein a cross-sectional area at the trailing end portion of the third conduit has a cross-sectional area approximately equal to a cross-sectional area of the second conduit, and wherein the cross-sectional area of the third conduit tapers down toward the leading end portion of the third conduit.

3. The apparatus of claim 1, further comprising a power terminal configured to supply energy to the atomizer, wherein the power terminal is configured to mate with a trailing end portion of the body.

4. The apparatus of claim 1, wherein the body further includes an outlet port configured to enable release of fluid from the body.

5. The apparatus of claim 1, wherein the body further includes an inlet port configured to enable an ingress of fluid into the body.

6. The apparatus of claim 1, further comprising wicking material, wherein the wicking material is proximate to the atomizer, and wherein the wicking material is configured to supply fluid to the atomizer.

7. The apparatus of claim 1, further comprising an insert configured to control fluid movement, wherein the insert is disposed within the second conduit.

8. An apparatus for dispensing and conditioning vapor, comprising:

an atomizer including a first conduit;

a body including a second conduit;

a mouth cap including a leading end portion, a trailing end portion, and a third conduit, the leading end portion of the third conduit having a cross-sectional area approximately equivalent to an internal diameter cross-sectional area of the first conduit; and a container disposed within the second conduit, the container including a leading end portion, a trailing end portion, and a fourth conduit, the fourth conduit having an internal diameter larger than the internal diameter of the first conduit, wherein the leading end portion of the container is in fluid communication with the trailing end portion of the mouth cap, and wherein the second conduit is configured to receive the vapor from the first conduit and cause expansion of the vapor to reduce a temperature of the vapor, and wherein the trailing end portion of the container is in fluid communication with the atomizer, wherein the fourth conduit is configured to allow expansion of vapor from the atomizer to reduce vapor temperature, and the third conduit is configured to compress the expanded vapor to maintain vapor density and regulate the vapor temperature.

9. The apparatus of claim 8, wherein a cross-sectional area at the trailing end portion of the third conduit has a cross-sectional area approximately equal to a cross-sectional area of the second conduit, and wherein the cross-sectional area of the third conduit tapers down toward the leading end portion of the third conduit.

10. The apparatus of claim 8, further comprising a power terminal configured to supply energy to the atomizer.

11. The apparatus of claim 8, wherein the body further includes an outlet port configured to enable release of fluid from the body.

12. The apparatus of claim 8, wherein the body further includes an inlet port configured to enable an ingress of fluid into the body.

13. The apparatus of claim 8, further comprising wicking material, wherein the wicking material is proximate to the atomizer, and wherein the wicking material is configured to supply fluid to the atomizer.

14. The apparatus of claim 8, further comprising an insert configured to control fluid flow, wherein the insert is disposed within the fourth conduit.

15. A method for dispensing and conditioning vapor, the method comprising:

atomizing a fluid by an atomizer, the atomizer having a first conduit with an internal diameter, the first conduit in fluid communication with a second conduit of a body, the second conduit larger than the first conduit;

expanding the fluid as the fluid enters the second conduit, wherein the second conduit is in fluid communication with a third conduit of a mouth cap;

compressing the fluid as the fluid enters the third conduit, wherein the expansion of the vapor in the second conduit reduces vapor temperature, and the compression of the vapor in the third conduit maintains vapor density; and delivering the conditioned vapor through the mouth cap at a temperature lower than the temperature of the vapor exiting the atomizer.

16. The method of claim 15, further comprising:

reducing a temperature of the fluid from a first temperature to a second temperature as the fluid enters the third conduit.

17. The method of claim 15, wherein the atomizing is performed by causing the fluid to enter the atomizer through a wicking material disposed around an outer surface of the atomizer.

18. The method of claim 15, further comprising supplying energy to the atomizer through a power terminal.

19. The method of claim 15, further comprising causing the fluid to enter or to exit the body through a port.

20. The method of claim 15, further comprising controlling a movement of the fluid through the second conduit by an insert disposed within the second conduit.

* * * * *